United States Patent [19]

Fournier

[11] Patent Number: 4,597,401

[45] Date of Patent: Jul. 1, 1986

[54] LIGHT WEIGHT TENT

[76] Inventor: James L. Fournier, P.O. Box 305, North Bennington, Vt. 05257

[21] Appl. No.: 629,684

[22] Filed: Jul. 11, 1984

[51] Int. Cl.[4] ..... A45F 1/00

[52] U.S. Cl. ..... 135/90; 135/87; 135/119

[58] Field of Search ..... 135/87, 90, 111, 115, 135/116, 119, 97; 52/DIG. 10

[56] References Cited

U.S. PATENT DOCUMENTS

| | | | |
|---|---|---|---|
| 2,567,697 | 9/1951 | Craighead, Jr. et al. | 135/90 |
| 3,374,797 | 3/1968 | Neumark | 135/87 |
| 4,308,883 | 1/1982 | Malone | 135/90 |

*Primary Examiner*—Robert A. Hafer
*Assistant Examiner*—Daniel Nolan
*Attorney, Agent, or Firm*—J. William Wigert, Jr.

[57] ABSTRACT

A tent is described which includes a pentagonal-shaped roof canopy detachable from a pentagonal-shaped floor, and a mosquito netting, enclosure in the form of a hemidodechohedron, which extends from the floor to the roof.

10 Claims, 7 Drawing Figures

LIGHT WEIGHT TENT

DESCRIPTION

1. Technical Field

The present invention relates to tents, and in particular to a light-weight and versatile tent.

2. Background Art

In many hiking and camping situations the amount of weight of the camping gear is of great importance. This is particularly true for backpackers. When backpacking in the summer, for example, it is often not desirable to take a full-fledged tent which might be required for camping in other seasons of the year. For this reason simple tarps or very small tents are frequently the summer backpacker's choice for shelter.

Both of these have their disadvantages. Although very lightweight, a tarp offers no protection against bugs and insects. Furthermore a tarp offers minimal shelter if rain or snow is encountered resulting in the ground being damp or wet.

Even small tents often add additional weight and bulk which are not desirable. Typically such tents require poles to support them, which must be carried by the backpacker. Frequently to reduce weight, such tents are so small that they provide little in the way of comfortable living space. Presently available tents necessarily provide a trade off between either good ventilation and visibility or rain protection, but not both simultaneously. Furthermore, most of such tents are better adapted to be utilized in flat areas, rather than in wooded or rocky areas. And finally, they are often expensive.

DISCLOSURE OF THE INVENTION

It is therefore an object of the invention to provide an improved tent.

Another object of the invention is to provide a tent which is both lightweight and versatile.

Another object of the invention is to provide a tent which is lightweight but which additionally provides shelter against the elements and protection against bugs and insects.

Another object of the invention is to provide a lightweight tent which does not require poles to support it.

Another object of the invention is to provide a lightweight tent which is adjustable from within.

Another object of the invention is to provide an improved tent which affords visibility, ventilation, and rain protection.

BEST MODE OF CARRYING OUT THE INVENTION

Figure 1:
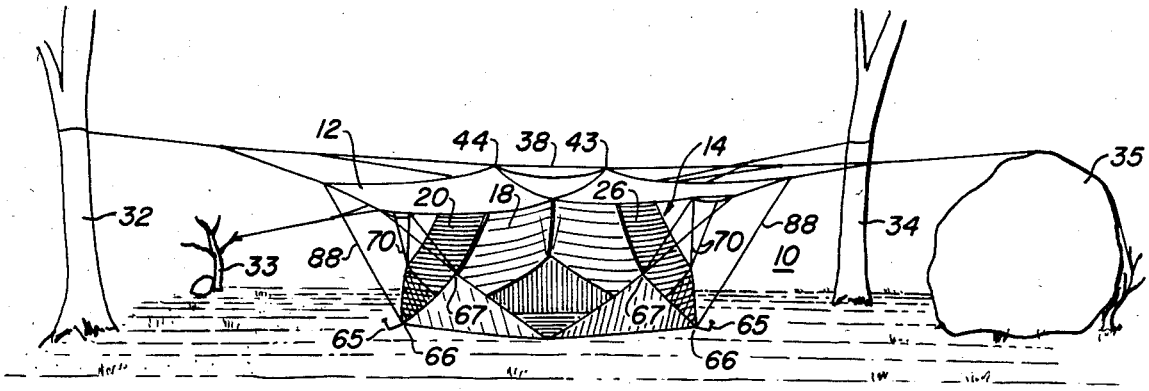
FIG. 1 is a semi-pictorial view of the lightweight tent of the present invention.
Figure 2:
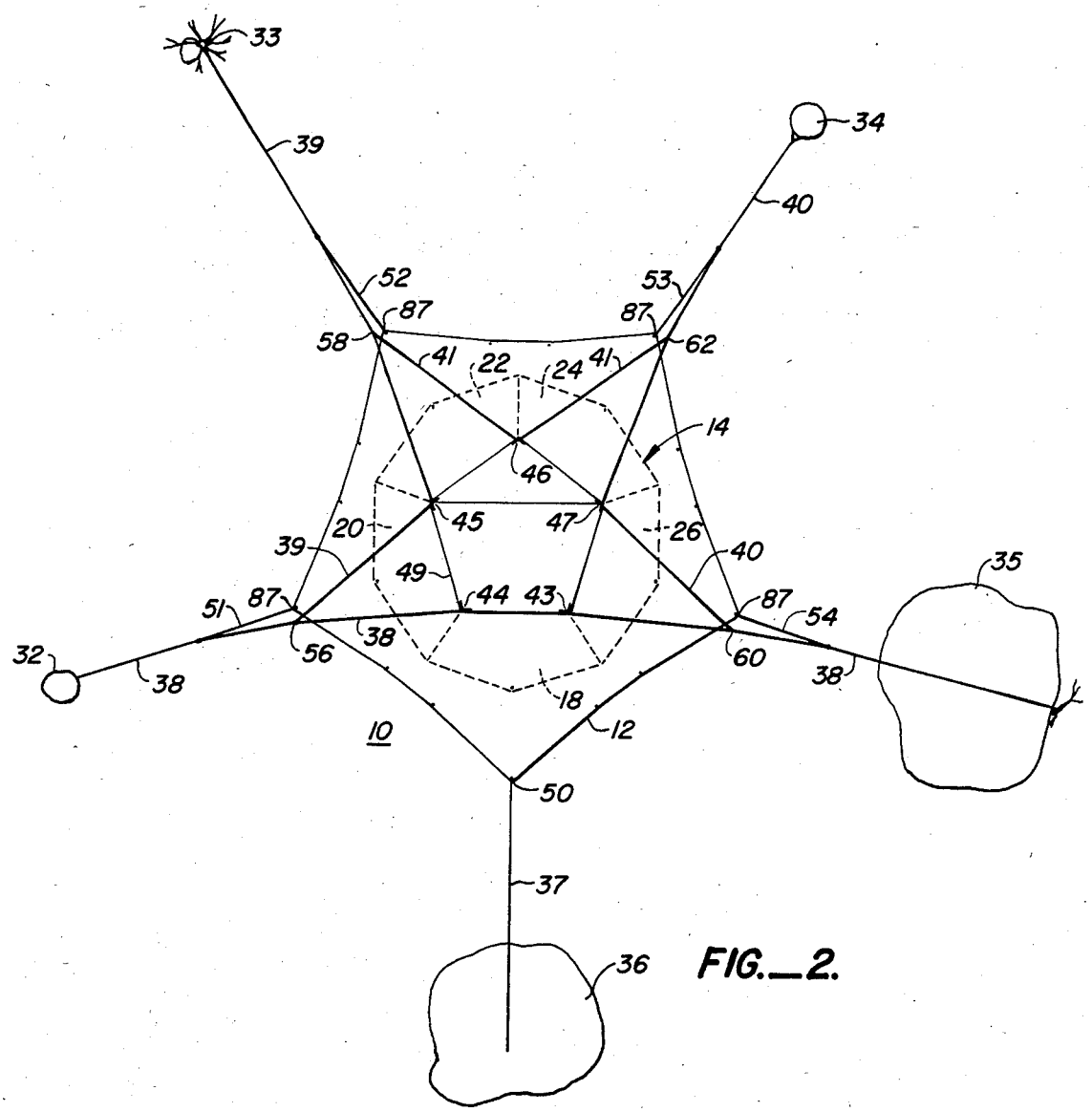
FIG. 2 is a plan view of the lightweight tent of FIG. 1.
Figure 3:
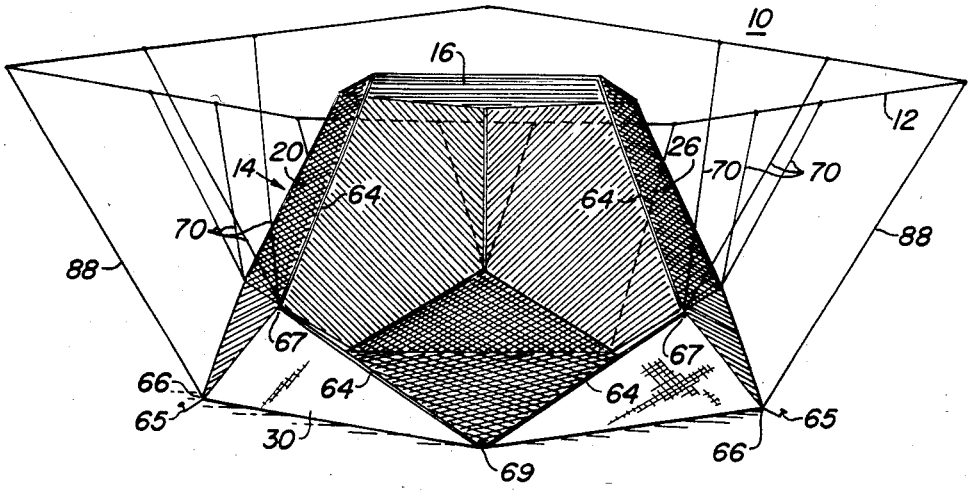
FIG. 3 is a schematic single point perspective representation of the tent of FIG. 1.
Figure 4:
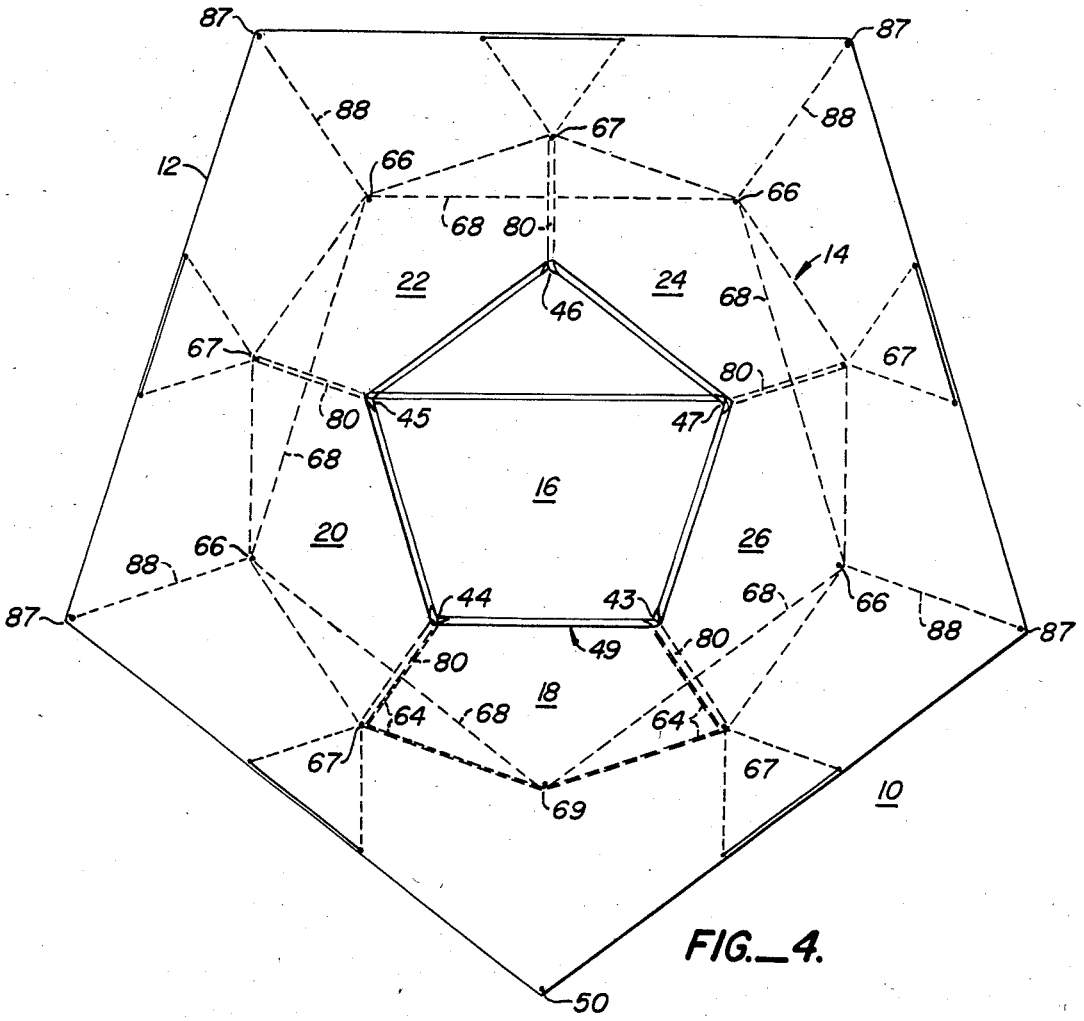
FIG. 4 is a plan view of the tent of FIG. 3.

The tent or shelter 10 of the present invention is pictorially shown in FIG. 1. It is composed of three main parts. The first is a pentagon shaped roof or canopy 12, which preferably is waterproof. The second is a mosquito netting enclosure 14 composed of six identical pentagonel panels or sections joined together to form half of a dodecohedron. Referring additionally to FIGS. 2–4, the six panels include a top panel 16, and five side panels, 18, 20, 22, 24, and 26. The third element is a pentagonally shaped floor 30, which is preferrably waterproof. The size of the perimeter of the floor 30 matches the lower, open part of the hemi-dodecohedron shaped enclosure 14 and the two parts are permanently joined along this perimeter.

In FIGS. 1 and 2, tent 10 is illustrated pitched between three trees 32–34 and boulders 35 and 36. Only five external tie points such as these, and no poles, are required to support the tent 10. All other line connections shown are made by semi-permanently tied slipknots. Four lines or cords 37–40 connect the roof 12 to the five external supports 32–36. Five webbing loop tiepoints 43–47 are provided on the upper side of the roof 12. These five tie points define a smaller pentagon-shaped area 49 within the roof 12. The size and shape of area 49 is substantially identical to that of the top panel 16 of the netting enclosure 14. As will be described in greater detail in connection with FIGS. 5–7, top panel 16 is elevated so as to be juxtapositioned against the underside of zone 49 of roof 12.

Cord 37 goes straight out from corner 50 of roof 12 to an external support, such as boulder 36. Cord 38 passes through tie loops 43 and 44 and is tied at one end to a second external support, tree 32, and at the other to a third external support, boulder 35. Cord 39 passes through tie loop 45 and is connected at one end 56 to cord 38 and at the other end to a fourth external support, tree 33. Cord 40 passes through tie loop 47 and is connected at one end 60 to cord 38 and the other end to a fifth external support, tree 34. Cord 41 passes through tie loop 46 and is connected at one end 58 to cord 39 and at the other end 62 to cord 40. While all of the five external supports shown here are elevated off of the ground, this is not a requirement for erecting tent 10. It is possible to use less than five; even a single vertically elevated support point can support the tent.

The view of tent 10 in FIGS. 1 and 3 is directly at the enclosure panel 18 which serves as a door to the tent. Door panel 18 has a zipper 64 which extends along the vertical borders with panels 20 and 26 and along its two sides attached to floor 30. When the door is to be opened, the zipper is unzipped and the panel is rolled upwardly and secured.

Stakes 65 are used to hold down the floor 30. The surface area of floor sheet 30 actually in contact with the ground forms a pentagonal floor bounded by the dotted lines 68 with corners 66. Stakes 65 are located at the midpoints 66 along each of the five sides of the pentagonally shaped floor sheet 30 rather than at the five corners 67. This enables five corners 67 of the floor sheet to be elevated from the ground in the form of five triangular pieces by bending along the dotted lines 68 shown in FIG. 4.

Figure 5:
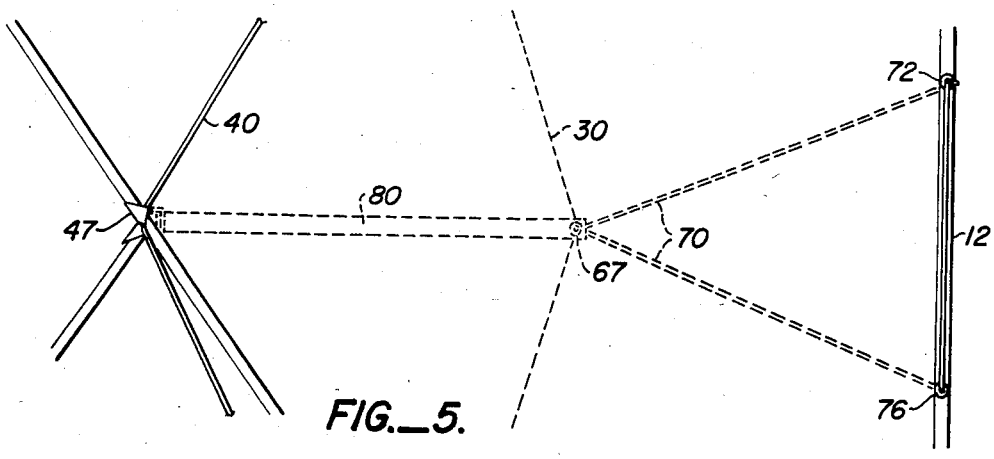
FIG. 5 is a plan view of a part of the tent shown in FIG. 3 illustrating details of the tent support system.
Figure 7:
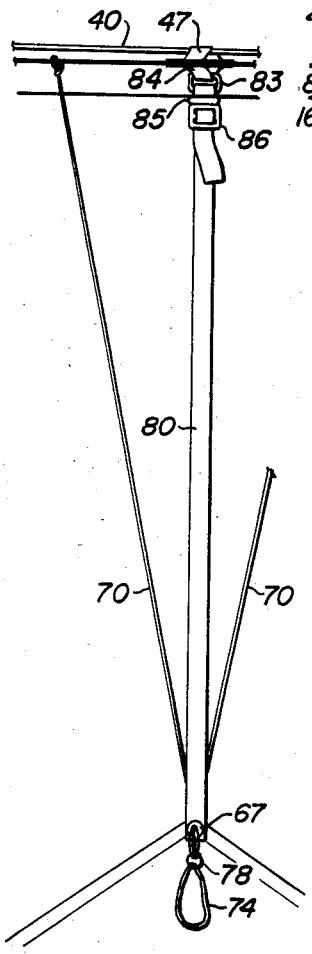
FIG. 7 is an elevation view of the details of the tent support system of FIG. 5.
Figure 6:
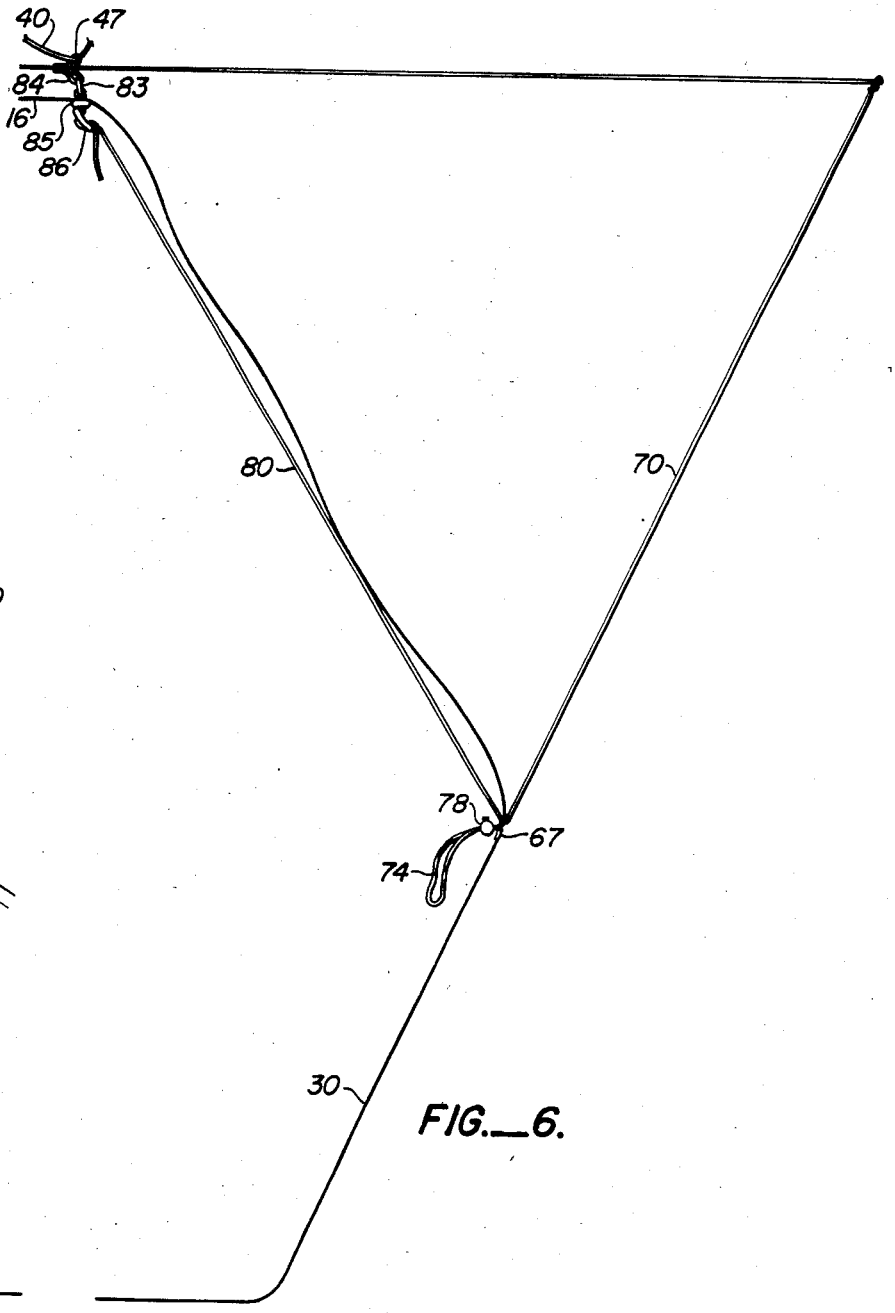
FIG. 6 is a side sectional view of the details of the tent support system of FIG. 5.

This is accomplished by means of five lines or cords 70, one of which is shown in greater detail in FIGS. 5–7. Cord 70 is attached at one end 72 to the roof canopy 12 through a grommet 72. It passes through another grommet at a point 67 in the floor 12 such that a loop 74 extends within the tent 10. The cord then passes back out of the tent though the grommet at point 67, and then through a grommet 76 in the roof canopy. Its other end is attached via grommet 72 to the roof 12. A slidable cord lock 78, such as sold under the trade designation "B-lok4" is used to adjust the effective length of cord 70. As slack is taken up, the floor section is pulled up and the roof 12 is pulled down, such that a trough is formed in the roof between grommets 72 and 76 for rain runoff. This adjustment is made entirely from within the tent 10.

Additional adjustments of the floor 30 can also be made from within the tent 10. Four cords 88 pass from the corners 87 of the roof 12, through a grommet 66 in floor 30, and then to each of the stakes 65. A loop (not shown), in each of the cords 88, similar to loops 74, and a cord lock (not shown) similar to cord lock 78, are provided within the tent. This enables the user to make adjustments to the floor and perimeter of the roof canopy from within.

Referring particularly to FIGS. 4–7, the means of holding up the mosquito netting enclosure 14 is described. A plastic loop 83 such as is sold under the trade designation "Fastex Looploc" is attached to the underside of the roof 12 by means of a webbing loop 84 sewn to the underside of roof 12. Five straps or webbings 80 are sewn and grommeted to the floor at each of the corner points 67. The other end of each of the webbings 80 passes through another plastic loop 85, then through a hole 82 in the top edge of the netting enclosure 14. Thereafter the webbing passes through loop 83 attached to the underside of roof 12, then back through the same hole 82, and then through loop 85. A sliding webbing lock 86 such as is sold under the trade designation "Fastex Tri-Glide" holds the netting 16 up against the loop 83 on the underside of roof 12.

Note that with this arrangement, the enclosure 14 and floor 30 are fully independent and separable from the roof 12. Thus, the user, if he elects, has the option of erecting the roof tarp 12 without having to erect the netting enclosure. Of course, in lieu of the arrangement described above the enclosure can be permanently attached to the underside of roof 12 if desired.

The tent is erected in the following manner. The tent is first spread out. The ends of the cords 88, which pass out through four of the five corners 66 of the floor, are staked. The corner of the floor at the base of the door is staked through grommet 69. The ends of cord 38 are tied to two external supports to elevate the center points 43 and 44. The free ends of cords 39, 40, and 37 are tied to external supports. Then cord 41 is tensioned by sliding its ends 58 and 62 along cords 39 and 40. Next, the cords 51, 52, 53 and 54, attached to the corners of the roof 87 are tensioned by sliding their ends along cords 38, 39 and 40. At this point the roof and floor of the tent are generally in place.

Next the webbing locks 86 are adjusted to gather slack in the netting enclosure. Thereafter the cords 70 are adjusted by means of cord lock 78 to provide rain channels in the roof 12. Finally, cords 88 are adjusted by means of cord lock 78 to take slack out of the floor, raise the low corners of the floor slightly off the ground and/or lower the corners 87 of the roof 12.

I claim:

1. A tent comprising:

a pentagonal-shaped roof canopy;

a central pentagonal zone within said roof canopy defined by five suspension points from which said roof canopy is supported;

a pentagonal-shaped floor; and a netting enclosure of six panels forming one-half of a dodechohedron, with said enclosure oriented such that the top panel thereof is in a plane with said central zone of said roof canopy and wherein the bottom corners of the five side panels thereof are located along the midpoints of said pentagonal-shaped floor.

2. A tent as in claim 1 wherein one of the five panels of said netting enclosure defines a door; and wherein it is joined to its adjacent side panels and to the floor by zippers.

3. A tent as in claim 2 wherein the bottom edges of each of the remaining four side panels of said netting enclosure are secured to said floor.

4. A tent as in claim 1 wherein said floor includes means for staking it at each of the midpoints thereof.

5. A tent as in claim 4 including means for additionally attaching lines to, and supporting, the corner points of said pentagonal-shaped roof canopy

6. A tent as in claim 5 including adjustable means for raising and lowering the corner points of said floor relative to said roof from within the tent.

7. A tent as in claim 1 including five adjustable straps for raising and maintaining the top panel of said netting enclosure in the plane of said central pentagonal roof zone, each of said straps being affixed at one end to a corner of said floor and at the other end to a suspension point location in said roof canopy.

8. A tent as in claim 7 wherein said straps are adjustable from within said tent.

9. A tent as in claim 4 including four cords which extend from four of the five corners of said roof canopy, pass through said floor, and then to each of said stakes, and means for adjusting the length of each of said cords from within said tent.

10. A tent as in claim 1 wherein said netting enclosure is detachable.

* * * * *